US010724319B2

(12) United States Patent
Hulsewe

(10) Patent No.: US 10,724,319 B2
(45) Date of Patent: Jul. 28, 2020

(54) WHIPSTOCK/BOTTOM HOLE ASSEMBLY ARRANGEMENT AND METHOD

(71) Applicant: Ewoud Hulsewe, The Woodlands, TX (US)

(72) Inventor: Ewoud Hulsewe, The Woodlands, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 12 days.

(21) Appl. No.: 15/414,336

(22) Filed: Jan. 24, 2017

(65) Prior Publication Data

US 2018/0209232 A1 Jul. 26, 2018

(51) Int. Cl.

| | |
|---|---|
| ***E21B 29/02*** | (2006.01) |
| ***E21B 7/06*** | (2006.01) |
| ***E21B 29/06*** | (2006.01) |
| ***E21B 17/06*** | (2006.01) |
| ***E21B 41/00*** | (2006.01) |
| ***E21B 29/08*** | (2006.01) |
| ***E21B 29/00*** | (2006.01) |
| ***E21B 17/00*** | (2006.01) |

(52) U.S. Cl.

CPC ..... *E21B 29/02* (2013.01); *E21B 7/061* (2013.01); *E21B 17/00* (2013.01); *E21B 29/06* (2013.01); *E21B 41/0035* (2013.01)

(58) Field of Classification Search

CPC ..... E21B 29/02; E21B 29/06; E21B 29/08; E21B 29/005

See application file for complete search history.

(56) References Cited

U.S. PATENT DOCUMENTS

| | | | | |
|---|---|---|---|---|
| 5,803,176 | A * | 9/1998 | Blizzard, Jr. | E21B 7/061 166/117.6 |
| 5,878,818 | A | 3/1999 | Hebert et al. | |
| 6,464,002 | B1 | 10/2002 | Hart et al. | |
| 6,695,056 | B2 | 2/2004 | Haugen et al. | |
| 7,878,253 | B2 | 2/2011 | Stowe et al. | |
| 8,327,944 | B2 | 12/2012 | King et al. | |

(Continued)

FOREIGN PATENT DOCUMENTS

| | | |
|---|---|---|
| EP | 0916014 A1 | 5/1999 |
| WO | 2016209686 A1 | 12/2016 |

OTHER PUBLICATIONS

Notification of Transmittal of the International Search Report and the Written Opinion of the International Searching Authority, or the Declaration; PCT/US2017/066117; dated Mar. 29, 2018; 13 pages.

(Continued)

*Primary Examiner* — David J Bagnell
*Assistant Examiner* — Manuel C Portocarrero
(74) *Attorney, Agent, or Firm* — Cantor Colburn LLP

(57) ABSTRACT

A whipstock/bottom hole assembly (BHA) arrangement including a whipstock, a BHA, an interconnection arrangement releasably securing the whipstock to the BHA, a fluid flow configuration in the BHA, the configuration directed at the interconnection arrangement. A method for releasing a whipstock from a whipstock/bottom hole assembly (BHA) arrangement as in any prior embodiment including flowing fluid through the fluid configuration, eroding the interconnection arrangement with the fluid, and separating the whipstock from the BHA.

14 Claims, 2 Drawing Sheets

(56) References Cited

U.S. PATENT DOCUMENTS

| | | | | |
|---|---|---|---|---|
| 8,967,279 | B2 | 3/2015 | Hered et al. | |
| 2004/0238171 | A1 | 12/2004 | McGarian et al. | |
| 2007/0044954 | A1 | 3/2007 | Dewey | |
| 2009/0266544 | A1* | 10/2009 | Redlinger | E21B 4/02 166/298 |
| 2010/0270031 | A1 | 10/2010 | Patel | |
| 2010/0319997 | A1 | 12/2010 | King et al. | |
| 2012/0255785 | A1 | 10/2012 | Gregurek et al. | |
| 2012/0261193 | A1* | 10/2012 | Swadi | E21B 7/061 175/61 |
| 2013/0020084 | A1 | 1/2013 | Goodson | |
| 2016/0238055 | A1 | 8/2016 | Donovan | |
| 2018/0209233 | A1 | 7/2018 | Hulsewe | |

OTHER PUBLICATIONS

Notification of Transmittal of the International Search Report and the Written Opinion of the International Searching Authority, or the Declaration; PCT/US2017/066119; dated Mar. 29, 2018; 10 pages.

* cited by examiner

WHIPSTOCK/BOTTOM HOLE ASSEMBLY ARRANGEMENT AND METHOD

BACKGROUND

In the downhole industry, whipstocks or other diverting tools are often run into a borehole hanging from the end of a milling or drilling bottom hole assembly (BHA) so that the whipstock may be positioned and anchored and then the BHA actuated to create the desired borehole exit (and potentially lateral borehole) in a single run. This methodology is well known to the industry. The whipstock is conventionally attached to the BHA by a configuration colloquially known as a lug and bolt. The lug generally extends through a portion of the whipstock and into connection with the BHA. The connection with the BHA generally requires a specially created interface such as a milled slot.

During use, the whipstock is landed and then torque, slack weight or both are used to shear the bolt from the lug thereby disconnecting the BHA from the whipstock and the milling or drilling operation can begin.

Systems as described work well for their intended purposes but research effort continues to be applied toward enhancing the connection between the whipstock and BHA during running to discourage or prevent premature separation and at the same time to reduce required input to cause the separation at the appropriate time. While alternatives have been proposed, they have not satiated the need and hence the art still pines for new solutions.

SUMMARY

A whipstock/bottom hole assembly (BHA) arrangement including a whipstock, a BHA, an interconnection arrangement releasably securing the whipstock to the BHA, a fluid flow configuration in the BHA, the configuration directed at the interconnection arrangement.

A method for releasing a whipstock from a whipstock/bottom hole assembly (BHA) arrangement as in any prior embodiment including flowing fluid through the fluid configuration, eroding the interconnection arrangement with the fluid, and separating the whipstock from the BHA.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
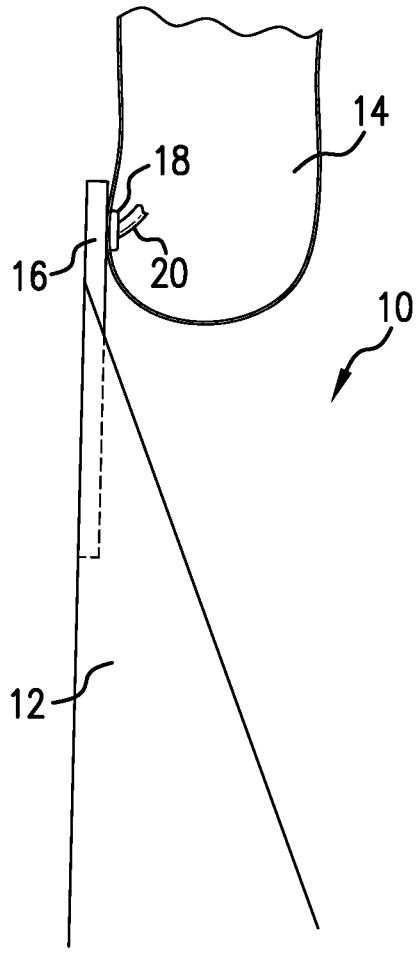
FIG. 1 schematically illustrates a structure taught herein.

Referring to FIG. 1, an arrangement 10 including a whipstock 12 and a bottom hole assembly (or portion thereof) 14 are secured to one another for run in to a borehole (not shown) by an interconnection arrangement 16 wherein the bottom hole assembly 14 includes a fluid flow configuration 18 that is positioned and directed to emit a fluid at the interconnection arrangement 16 such that the interconnection arrangement will be eroded or otherwise degraded by the fluid. The arrangement allows for a robust interconnection arrangement 16. Such a robust interconnection arrangement will reduce issues related to premature release of the whipstock during running, which of course reduces cost and avoids lost time. After proper setting of the whipstock 12 and degradation of the interconnection arrangement 16 by the fluid emanating from the fluid flow configuration 18, release of the whipstock is easier than in other arrangements. This results in reliable release of the whipstock only at an appropriate time and with reduced torque, reduced set down weight or both with respect to prior art configurations.

It should be understood that the concept disclosed herein is applicable to many different types of interconnection arrangements providing they are accessible to fluid flow and susceptible to degradation by fluid impingement thereon as taught herein. This includes any type of prior art interconnection arrangement and includes the interconnection arrangements illustrated in co-pending U.S. application Ser. No. 15/414,276, which is fully incorporated herein by reference. Particularly suitable interconnection arrangements are those constructed of composite materials or softer metallic materials or even Controlled Electrolytic Metallic material (CEM) materials (available from Baker Hughes Incorporated) that will degrade on their own in the presence of a particular fluid but whose degradation rate will be enhanced by impinging fluid. For interconnection arrangement types that are older in the art and comprise high strength or hardness materials sometimes configured as Lugs a more aggressive solids content may be expedient to speed degradation of such materials. In such a case, consideration should be given to the fluid flow direction to avoid eroding the face of the whipstock more than necessary. In other words, the fluid flow configuration would be aimed so as to impinge upon the interconnection arrangement 16 directly but in such a way as to avoid direct or even indirect but still energetic impingement on the whipstock itself.

In embodiments, the fluid is applied to the interconnection arrangement 16 at velocities consistent with degradation of the interconnection arrangement in the desired time frame. It will be appreciated that the period of time over which degradation occurs is affected by the material of the interconnection arrangement, the velocity of the fluid, the solids content of the fluid the chemical makeup of the fluid and the temperature of the fluid and/or the interconnection arrangement. Each of these properties may be adjusted for a particular iteration of this disclosure. For example, a higher velocity impingement of the fluid on the interconnection arrangement 16 will result in a more rapid degradation of the interconnection arrangement 16. Too, adding solids content to the fluid will increase the erosional effect of the impinging fluid. Changing the velocity of fluid impingement can be accomplished by employing a nozzle as the fluid flow configuration 18 or it can be accomplished by pumping fluid at a higher rate through the configuration 18.

Fluid contemplated includes fluid otherwise needed for further operations such as drilling mud or brine that would be supplied in any event or a fluid that is a dedicated fluid used solely for the purpose of degrading the interconnection arrangement, for example a solids laden fluid, etc. Accordingly, the fluid may be supplied through a supply 20 such as the string (e.g. a drill string, not shown) as in the prior art and then simply diverted at the BHA to impinge upon the interconnection arrangement or a specific line may be piped to the BHA for this sole purpose.

Figure 2:
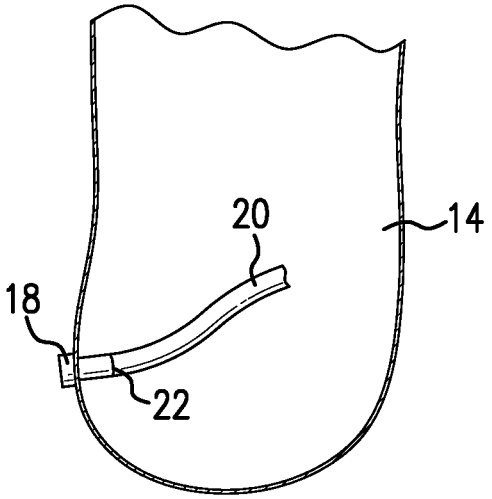
FIG. 2 is an enlarged view of a fluid flow path to a fluid flow configuration having a pressure release device blocking fluid flow.
Figure 3:
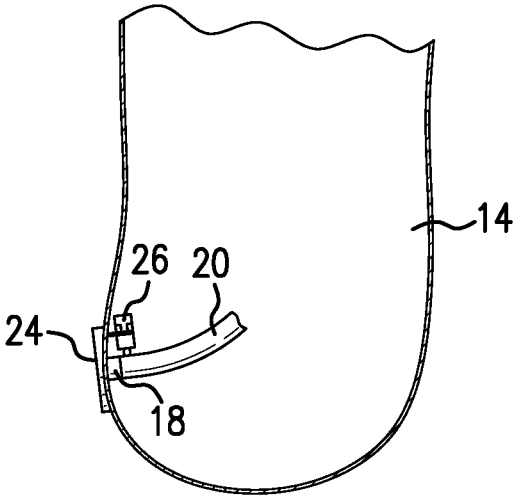
FIG. 3 is an enlarged view of a fluid flow path to a fluid flow configuration having a sleeve blocking fluid flow with piston actuation.
Figure 4:
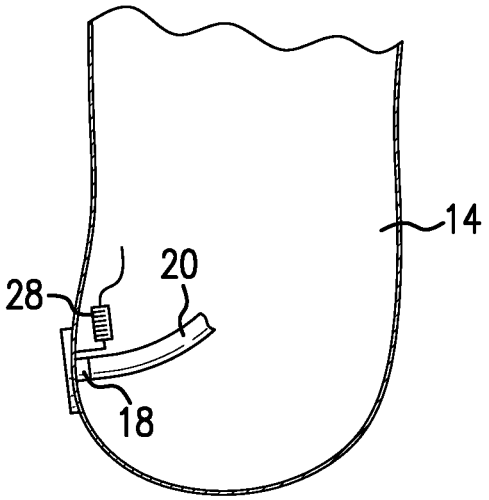
FIG. 4 is an enlarged view of a fluid flow path to a fluid flow configuration having a sleeve blocking fluid flow with solenoid actuation.

In an embodiment, the fluid flow configuration 18 may employ a closure member such as a pressure defeatable device 22 (See FIG. 2), for example, a burst disk or a sleeve 24 (see FIG. 3) to close the configuration 18 until needed. Where a sleeve 24 or other covering is employed, it may be removed via pressure on a piston 26 (FIG. 3) or electrically via for example a solenoid 28 (FIG. 4), etc.

A method for releasing a whipstock from any of the whipstock/bottom hole assembly (BHA) arrangements described hereinabove. The whipstock is then set in the borehole and ready to be released. At this point depending upon configuration the operator may simply increase fluid flow so that degradation of the interconnection arrangement takes place or a signal (pressure or electrical for example) is sent to a cover preventing fluid flow such that fluid flow is then enabled. Once flow is enabled along normal drilling mud flow paths or through a dedicated fluid line if so equipped, fluid (mud, brine, other specific fluid such an a solids laden slurry, etc.) is impinged upon the interconnection arrangement until the interconnection arrangement is sufficiently degraded for release of the whipstock to be effected through torque, set down weight or both at values selected by the operator.

Set forth below are some embodiments of the foregoing disclosure:

Embodiment 1

A whipstock/bottom hole assembly (BHA) arrangement including a whipstock, a BHA, an interconnection arrangement releasably securing the whipstock to the BHA, a fluid flow configuration in the BHA, the configuration directed at the interconnection arrangement.

Embodiment 2

The whipstock/bottom hole assembly (BHA) arrangement as in the prior embodiment wherein the interconnection arrangement comprises a composite material.

Embodiment 3

The whipstock/bottom hole assembly (BHA) arrangement as in any prior embodiment wherein the fluid configuration is a part of a drilling fluid distribution system.

Embodiment 4

The whipstock/bottom hole assembly (BHA) arrangement as in any prior embodiment wherein the fluid configuration further includes a closure member.

Embodiment 5

The whipstock/bottom hole assembly (BHA) arrangement as in any prior embodiment wherein the member is a pressure defeatable.

Embodiment 6

The whipstock/bottom hole assembly (BHA) arrangement as in any prior embodiment wherein the member is a burst disk.

Embodiment 7

The whipstock/bottom hole assembly (BHA) arrangement as in any prior embodiment wherein the member is electrically defeatable.

Embodiment 8

The whipstock/bottom hole assembly (BHA) arrangement as in any prior embodiment wherein the member is responsive to a solenoid.

Embodiment 9

The whipstock/bottom hole assembly (BHA) arrangement as in any prior embodiment wherein the fluid configuration includes a nozzle to one or more of increase fluid velocity and change fluid flow direction.

Embodiment 10

A method for releasing a whipstock from a whipstock/bottom hole assembly (BHA) arrangement as in any prior embodiment including flowing fluid through the fluid configuration, eroding the interconnection arrangement with the fluid, and separating the whipstock from the BHA.

Embodiment 11

The method as in any prior embodiment wherein the fluid is one or more of mud and brine.

Embodiment 12

The method as in any prior embodiment wherein the separating further includes applying one or more of torque and set down weight.

Embodiment 13

The method as in any prior embodiment wherein the method further includes overcoming a pressure defeatable member at the BHA.

Embodiment 14

The method as in any prior embodiment wherein the method further includes signaling a closure member at the BHA to open to fluid flow.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A whipstock/bottom hole assembly (BHA) arrangement comprising:

a whipstock;

a BHA;

an interconnection arrangement releasably securing the whipstock to the BHA;

a fluid flow configuration in the BHA, the configuration aimed such that fluid passing through the configuration impinges upon the interconnection arrangement directly causing erosion and/or degradation of the interconnection arrangement during use of the fluid flow configuration.

2. The whipstock/bottom hole assembly (BHA) arrangement as claimed in claim 1 wherein the interconnection arrangement comprises a composite material.

3. The whipstock/bottom hole assembly (BHA) arrangement as claimed in claim 1 wherein the fluid configuration is a part of a drilling fluid distribution system.

4. The whipstock/bottom hole assembly (BHA) arrangement as claimed in claim 1 wherein the fluid configuration further includes a closure member.

5. The whipstock/bottom hole assembly (BHA) arrangement as claimed in claim 4 wherein the member is a pressure defeatable.

6. The whipstock/bottom hole assembly (BHA) arrangement as claimed in claim 5 wherein the member is a burst disk.

7. The whipstock/bottom hole assembly (BHA) arrangement as claimed in claim 4 wherein the member is electrically defeatable.

8. The whipstock/bottom hole assembly (BHA) arrangement as claimed in claim 7 wherein the member is responsive to a solenoid.

9. The whipstock/bottom hole assembly (BHA) arrangement as claimed in claim 1 wherein the fluid configuration includes a nozzle to one or more of increase fluid velocity and change fluid flow direction.

10. A method for releasing a whipstock from a whipstock/bottom hole assembly (BHA) arrangement as claimed in claim 1 comprising:

flowing fluid through the fluid configuration;

eroding the interconnection arrangement with the fluid; and separating the whipstock from the BHA.

11. The method as claimed in claim 10 wherein the fluid is one or more of mud and brine.

12. The method as claimed in claim 10 wherein the separating further includes applying one or more of torque and set down weight.

13. The method as claimed in claim 10 wherein the method further includes overcoming a pressure defeatable member at the BHA.

14. The method as claimed in claim 10 wherein the method further includes signaling a closure member at the BHA to open to fluid flow.

* * * * *